United States Patent [19]

Takeo et al.

[11] Patent Number: 4,571,103

[45] Date of Patent: Feb. 18, 1986

[54] PRINTER

[75] Inventors: Seiji Takeo; Akira Amari, both of Tokyo, Japan

[73] Assignee: NEC Corporation, Tokyo, Japan

[21] Appl. No.: 659,569

[22] Filed: Oct. 10, 1984

[30] Foreign Application Priority Data

Oct. 17, 1983 [JP] Japan ..... 58-193810

[51] Int. Cl.[4] ..... B41J 11/00

[52] U.S. Cl. ..... 400/616.2; 400/616.1

[58] Field of Search ..... 400/616, 616.1, 616.2, 400/616.3; 226/64, 74, 110

[56] References Cited

U.S. PATENT DOCUMENTS 2,140,028 12/1938 Nichols ..... 400/616.1
2,215,481 9/1940 Sherman ..... 400/618 X
2,355,668 8/1944 Morse ..... 400/616.1 X
4,440,516 4/1984 Rosenthal et al. ..... 400/616.1

FOREIGN PATENT DOCUMENTS 704952 3/1954 United Kingdom ..... 400/616
825154 12/1959 United Kingdom ..... 400/616.1

*Primary Examiner*—Edgar S. Burr
*Assistant Examiner*—John A. Weresh
*Attorney, Agent, or Firm*—Laff, Whitesel, Conte & Saret

[57] ABSTRACT

A printer includes a head and a platen mounted in a chassis. A paper tractor may be mounted on the chassis in either of two rotary positions either to pull or to push the paper, respectively, past the platen. The difference between the two positions is a rotary angle at which the tractor sits relative to the parts of the printing machine.

4 Claims, 10 Drawing Figures

PRINTER

BACKGROUND OF THE INVENTION

This invention relates to a printer and, more particularly, to a printer capable of having both a push-tractor type structure and a pull-tractor type structure.

Conventional printers were classified into either one of the pull-tractor type and the push-tractor type depending on the relationship between paper and a tractor.

Referring now to FIG. 1, a conventional pull-tractor type printer comprises a cylindrical platen 1 for supporting paper 3 from the rearside thereof to absorb the impact generated at the time of printing by a head 4, and a tractor 2 for pulling out the paper 3 from the platen. In this type of structure, however, since the paper is pulled by the tractor 2, the paper 3 cannot be cut at any location between the platen 1 and the tractor 2. For this reason, when a piece of paper 3 is cut out immediately after the printing, an operator must wait until the desired printed portion on the paper has passed through the tractor 2 to cut out said portion at a cutting position 8 behind the tractor 2. As a result, every time the paper is cut, the length of paper equal to the distance between the head 4 and the tractor 2 is inevitably wasted.

Referring to FIG. 2, a conventional push-tractor type printer comprises a platen 1 and a tractor 2 for feeding paper 3 to the platen 1. However, this type of structure is not suitable for multiple paper, which is composed of several sheets of paper stacked. As shown in FIG. 3, when multiple paper 10 is used, as the rotational radius of the inner side paper 11 close to the platen 1 is slightly shorter than that of the outer side paper 12 of the paper 10, the amount of feed of the paper 11 becomes smaller than that of the paper 12. This difference in the amount of feed causes a slack 13 of the paper 11. As the multiple paper 10 is continuously fed, the amount of the slack 13 increases and the slack 13 gradually accumulates large enough to jam. As a result, the feed of the paper 10 eventually becomes impossible. Such a conventional pull-tractor type printer is disclosed in the U.S. Pat. No. 4,344,715.

One object of the present invention is, therefore, to provide a printer free from the above-mentioned disadvantages of the prior art and capable of achieving both the pull-tractor and push-tractor type structures.

SUMMARY OF THE INVENTION

According to one aspect of the invention, there is provided a printer having a head for printing paper and a tractor drive mechanism, both of which are mounted on a chassis, the printer comprising: a cylindrical platen disposed opposite to the head for supporting the paper from the rearside thereof so that the impact caused in the printing operation can be absorbed, the platen being provided between sides of the chassis; tractors for driving the paper across the platen; and support means for supporting the tractors at a first position which allows the tractors to pull out the paper printed by the head from said platen when operated in pull-tractor type fashion and for supporting the tractors at a second position which is inclined from the first position by a predetermined angle to allow the tractors to feed the paper to the platen before printing when operated in push-tractor type fashion; whereby the printer can have both a pull-tractor type structure and a push-tractor type structure.

BRIEF DESCRIPTION OF THE DRAWINGS

The features and advantages of the present invention will become apparent from the following description when taken in conjunction with the accompanying drawings in which.

In the drawings, the same reference numerals represent the same structural elements.

DETAILED DESCRIPTION OF THE PREFERRED EMBODIMENT

Figure 1:
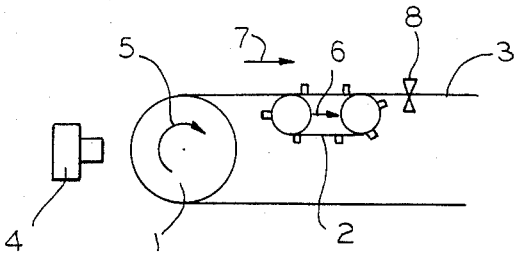
FIG. 1 (PRIOR ART)
FIG. 1 is a diagram of a conventional pull-tractor type printer.
Figure 2:
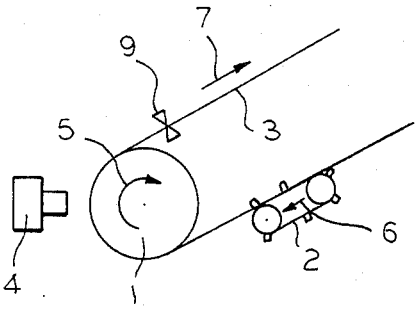
FIG. 2 (PRIOR ART)
FIGS. 2 and 3 are diagrams of a conventional push-tractor type printer.
Figure 3:
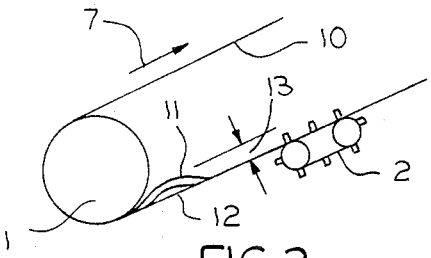
FIG. 3 (PRIOR ART)
Figure 4:
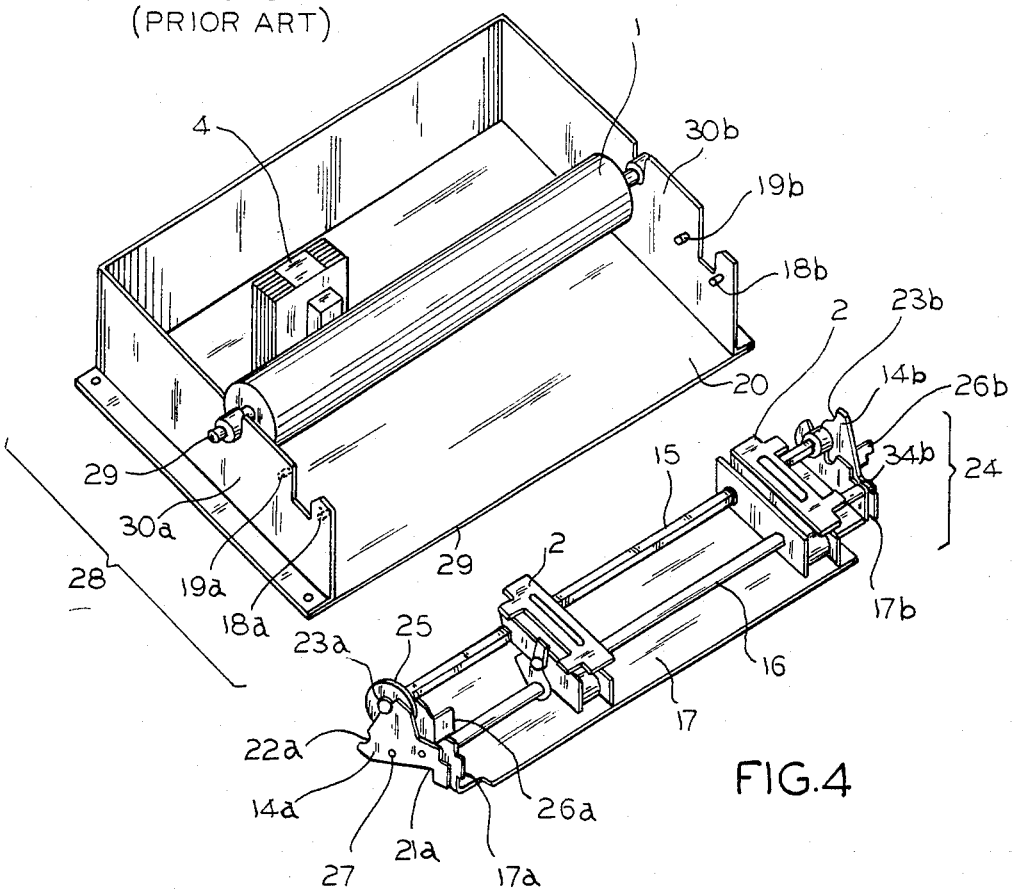
FIG. 4 is a decomposed perspective view of an embodiment of the invention.
Figure 5:
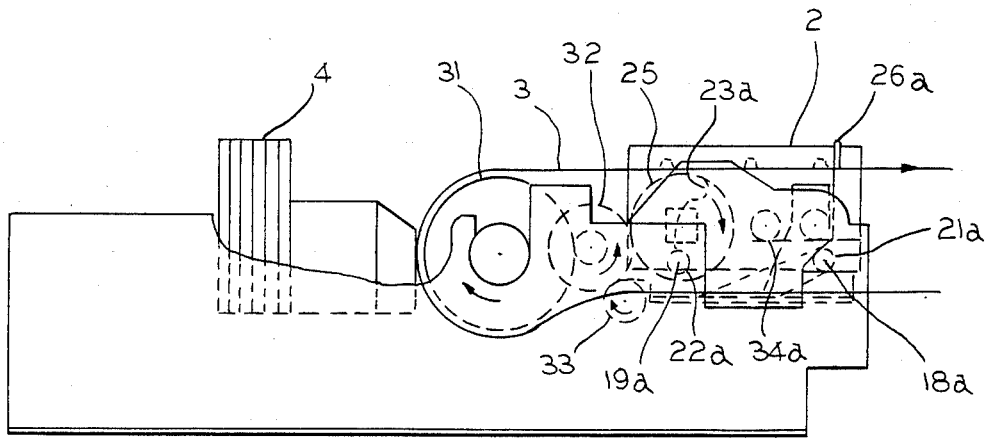
FIGS. 5, 6, and 7 are a side view, a perspective view and a partially enlarged side view respectively of the embodiment when used in the pull-tractor type structure.

Referring now to FIGS. 4 and 5, an embodiment of the present invention comprises a printer body 28 and a tractor assembly 24. The assembly 24 comprises a pair of tractors 2; a support rod 16 for supporting the tractors 2; a drive bar 15 whose rotation causes the tractors 2 to advance paper, a tractor gear 25 coupled onto one end of the bar 15; a chassis 17 for mounting the tractors 2, the rod 16, the bar 15 and the gear 25; support plates **14*a* and 14*b* provided on sides 17*a* and 17*b* of the chassis 17 via pins 27 respectively; knobs 26*a* and 26*b* provided at a space between the side 17*a* and the plate 14*a* and at a space between the side 17*b* and the plate 14*b* respectively to rotate around the axis of the rod 16; and torsion springs 34*a* and 34*b* provided, on both ends of the rod 16 to constantly apply torque to knobs 26*a* and 26*b***.

The printer body 28, on the other hand, comprises a chassis 29, first projections **19*a* and 19*b* and second projections 18*a* and 18*b* formed on sides 30*a* and 30*b* of the chassis 29, a print head 4, and a platen 1**.

Figure 7:
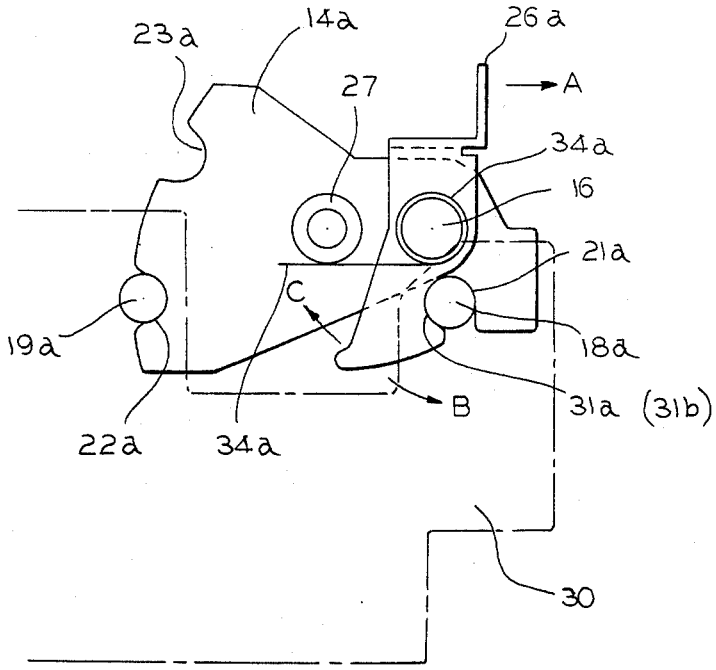
Figure 6:
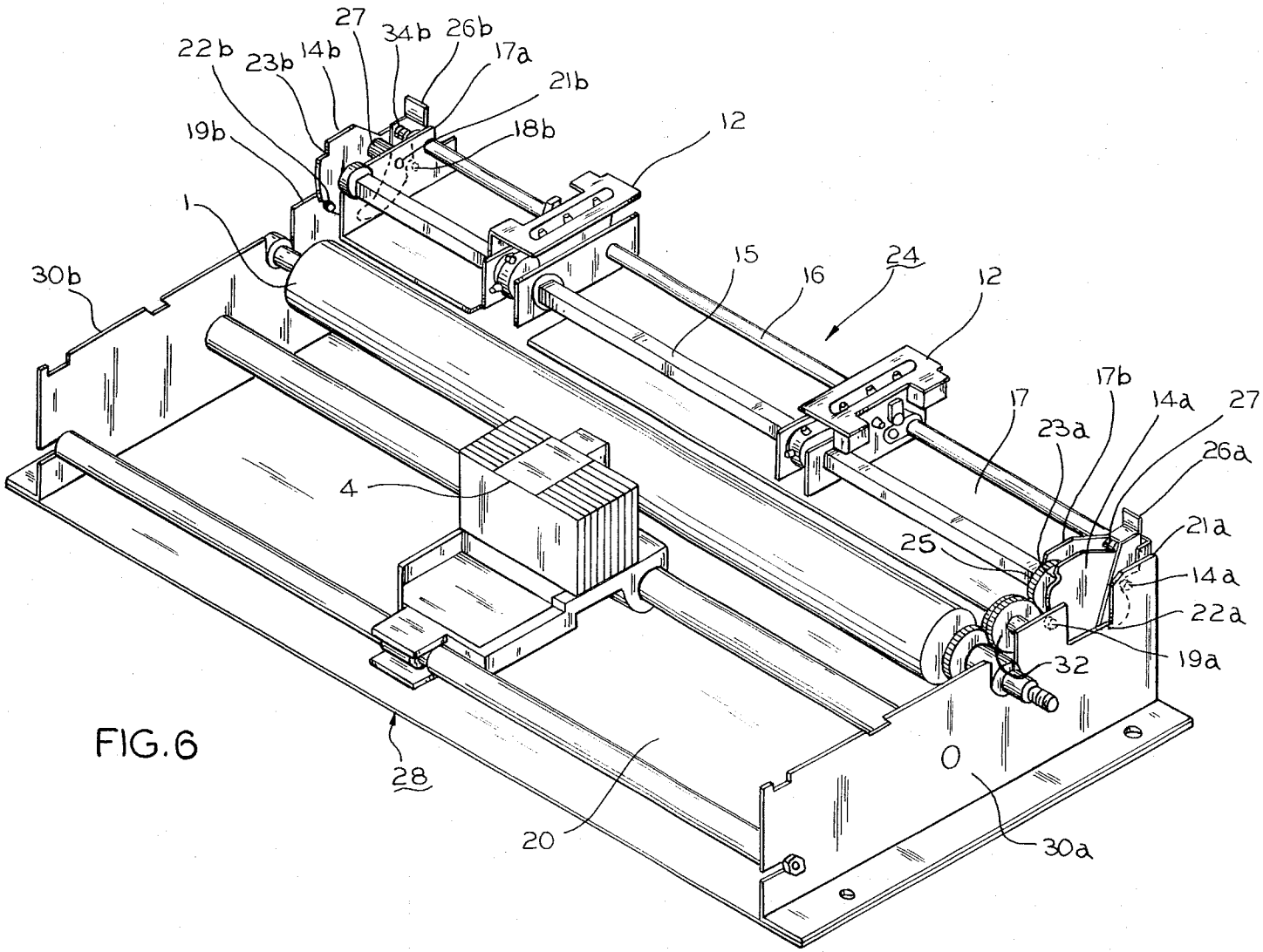

Referring to FIGS. 6 and 7, the support plate **14*a* (14*b*) includes notches 22*a* and 23*a* (22*b* and 23*b*) formed adjacent to each other, and a curved portion 21*a* (21*b*) having a contour engageable to the contour of the projection 18*a* (18*b***).

Referring to FIGS. 5 through 7, description will now be given to the case where the embodiment is applied to a pull-tractor type structure. The projections **19*a* and 19*b* are first engaged with the notches 22*a* and 22*b*. Then, an external force is applied to the knobs 26*a* and 26*b* in the direction of an arrow A (shown in FIG. 7) by an operator's finger to rotate the knobs 26*a* and 26*b* around the rod 16 by a desired angle. This permits the lower ends of the knobs 26*a* and 26*b* to move in the direction of an arrow C. As a result, the curved portions 21*a* and 21*b* of the plates 14*a* and 14*b* becomes engaged with the projections 18*a* and 18*b*. After the engagement of the portions 21*a* and 21*b* with the projections 18*a* and 18*b*, if the force applied to the knobs is released, the knobs 26*a* and 26*b* will rotate around the rod 16 in the direction of an arrow B due to the elasticity of the springs 34*a* and 34*b*. This revolution allows the projections 18*a* and 18*b* to be held between the portion 21*a* of the plate 14***a* and a curved portion 31*a* of the knob 26*a* and between the portion 21*b* of the plate 14*b* and a curved portion 31*b* of the knob 26*b*. In this manner, the assembly 24 and the body 28 are fixed to each other with the plates 14*a* and 14*b* and the knobs 26*a* and 26*b* of the assembly 24 as well as with the projections 18*a*, 18*b*, 19*a* and 19*b* of the body 28. The gear 25 is driven with a motor pinion gear 33 via a gear 32 provided on the side 30*a* of the body 28. The gear 33 is attached to a motor (not shown) and rotated by the motor. The rotation of the gear 25 drives the tractor 2 to pull out the paper 3 which has been printed with the head 4.

Figure 8:
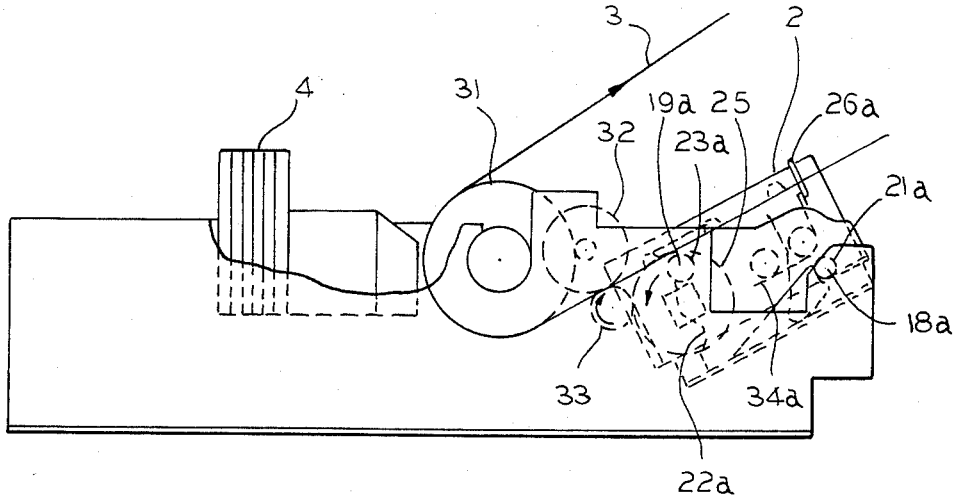
FIGS. 8, 9, and 10 are a side view, a perspective view and a partially enlarged side view of the embodiment when used in the push-tractor type structure.
Figure 10:
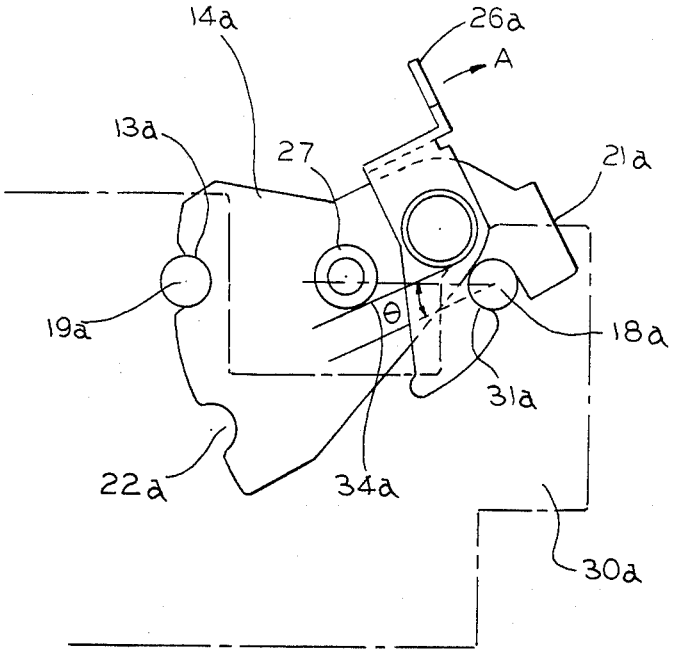
Figure 9:
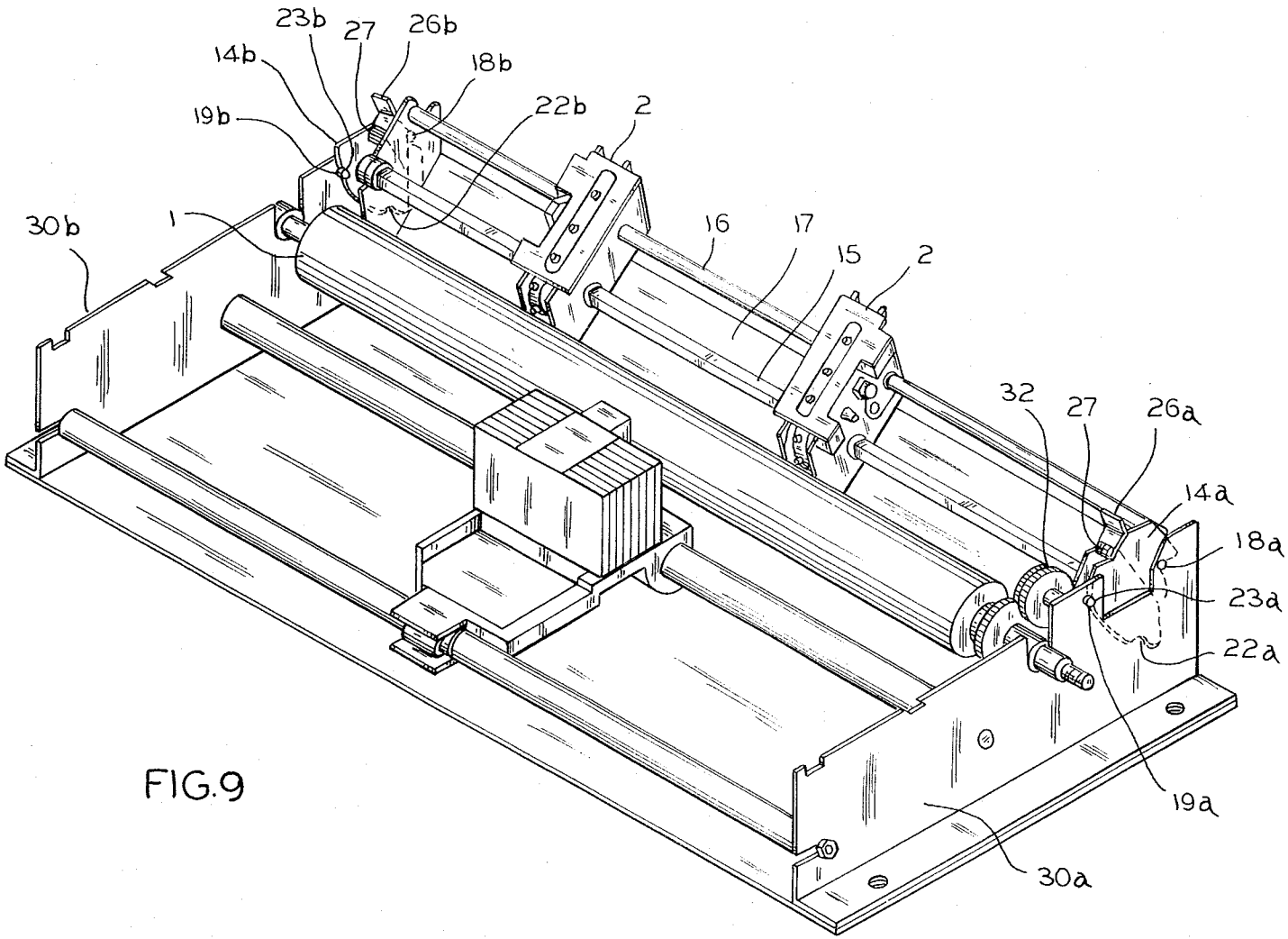

Referring to FIGS. 8 through 10, description will next be given to the case where the embodiment is applied to a push-tractor type structure. The notches 23*a* and 23*b* of the support plates 14*a* and 14*b* are engaged with the projections 19*a* and 19*b* of the sides 30*a* and 30*b*. Then an external force is applied to the knobs 26*a* and 26*b* in the direction of an arrow A (shown in FIG. 10) by an operator's finger. In the manner similar to that described for the pull-tractor type structure, the projections 18*a* and 18*b* are held between the curved portion 21*a* and the curved portion 31*a* and between the portion 21*b* and the portion 31*b*. In this state, the assembly 24 is supported but inclined by an angle $\theta$ from the position of the assembly 24 in the pull-tractor type structure. In the push-tractor type structure, the gear 25 is directly driven by the gear 33. The tractors 2 driven by the rotation of the gear 25 feed the paper 3 to be printed near the head 4. The reduction ratio of the gear 25 against the gear 33 is expressed by the following equation, where the number of teeth of the gear 33 is $n_1$, that of the gear 32 is $n_2$ and that of the gear 25 is $n_3$:

$$\frac{n_2}{n_1} \times \frac{n_3}{n_2} = \frac{n_3}{n_1} \quad (1)$$

for the pull-tractor type structure, and $$\frac{n_3}{n_1} \quad (2)$$

for the push-tractor type structure. The reduction ratio is equal in both structures. Therefore, the rotation speed of the gear 25 is the same in both pull-tractor type and push-tractor type structures so that the paper can be fed in both structures at the same speed without taking trouble to change the revolution-per-minute speed of the motor.

As described in the foregoing description, the invention has an advantage in that if multiple paper is employed, the printer can be switched to the pull-tractor type structure while if the paper should be cut near the platen immediately after printing, it can be switched to the push-tractor type structure.

What is claimed is:

1. A printer having a head for printing on paper and a tractor drive mechanism for transporting said paper past said head, both said head and said tractor being mounted on a chassis, said printer comprising: a cylindrical platen supported on said chassis and disposed opposite said head for supporting said paper to absorb an impact caused by the head striking said paper during the printing operation, the platen being positioned between sides of said chassis; tractor means for driving the paper across said platen; means for selectively converting said tractor means to either a pull type tractor structure or a push type tractor structure including support means for supporting said tractor means for movement between a first position which positions said tractor means to pull paper from said platen after having been printed by said head thereby positioning said tractor means for a pull-tractor type operation and displaced from said first position a second position which positions said tractor means to feed said paper to said platen before printing thereby positions said tractor means for a push-tractor type operation, whereby the tractor structure can selectively provide either a pull-tractor type structure or a push-tractor type structure depending upon which of said two positions said tractor occupies.

2. A printer as claimed in claim 1, in which said support means comprises: a support rod on which said tractor means is attached; two first projections and two second projections formed on said sides of said chassis; and plates attached at both ends of said rod to be connectable to said first projections, each of the plates having a first notch which engages a corresponding one of said second projections, respectively when operated in the pull-tractor type fashion and having a second notch which engages said corresponding one of said second projections, respectively when operated in the push-tractor type fashion.

3. A system for transporting paper through a printer, comprising a printing head, a platen, tractor means mounted to move between two distinct positions, and a chassis for supporting said printer head in a position confronting said platen with said tractor means positioned to transport paper between said printer head and said platen, support means pivotally attached to said chassis for securing the tractor means in either of two rotary positions adjacent said platen, and means responsive to a rotation of said support means about said pivot for changing the angle relative to the chassis at which said tractor means transports paper past said platen, said tractor means being selectively positioned in one of said positions to pull or, in the other of said positions to push the paper between the platen and the head wherein said support means includes a plate which has notches for defining two resting positions, one of said resting positions placing said tractor means in a position which pulls said paper horizontally from said platen, and the other of said resting positions raises said tractor means to a position which pushes said paper angularly into said roller, and detent means on said chassis for cooperating with said notches for fixing the position of said plate.

4. The system of claim 3 and means for locking the selected notch on said plate and said detent means to secure said tractor means into the selected position.

* * * * *